United States Patent [19]

Suzuki

[11] 4,041,917

[45] Aug. 16, 1977

[54] EXHAUST GAS RECIRCULATION SYSTEM

[75] Inventor: Yukio Suzuki, Toyota, Japan

[73] Assignee: Toyota Jidosha Kogyo Kabushiki Kaisha, Toyota, Japan

[21] Appl. No.: 699,038

[22] Filed: June 21, 1976

[30] Foreign Application Priority Data

Apr. 19, 1976 Japan ..... 51-47891[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,802,402 | 4/1974 | Swatman | 123/119 A |
| 3,814,070 | 6/1974 | Wertheimer | 123/119 A |
| 3,881,456 | 5/1975 | Nohira et al. | 123/119 A |
| 3,888,143 | 6/1975 | Kolehmainen et al. | 123/119 A |
| 3,896,777 | 7/1975 | Masaki et al. | 123/119 A |
| 3,901,202 | 8/1975 | Hollis et al. | 123/119 A |

*Primary Examiner*—Wendell E. Burns
*Attorney, Agent, or Firm*—Stevens, Davis, Miller & Mosher

[57] ABSTRACT

This application discloses an EGR system in which the vacuum control valve is improved to comprise:

a first diaphragm;

a second diaphragm;

a first chamber which is formed outside said first diaphragm and communicating with the atmosphere;

a second chamber which is formed between said first and second diaphragm and communicating with the pressure control chamber of the EGR valve, and;

a third chamber which is formed outside said second diaphragm and communicating with the intake pipe of the engine at the downstream of the throttle valve of the carburetor.

3 Claims, 3 Drawing Figures

EXHAUST GAS RECIRCULATION SYSTEM

BACKGROUND OF THE INVENTION

This invention relates to an exhaust gas recirculation system (EGR system) for reducing $NO_x$ (Nitrogen Oxides) emmissions, especially to the improvement of the back pressure controlling type EGR system.

The known back pressure controlling type EGR system comprises:

- a diaphragm type EGR valve mounted on a EGR pipe which connects the exhaust pipe with the intake pipe of the engine;
- a pressure control chamber formed at the inlet of said EGR valve;
- an orifice mounted on a communicating pipe which connects the diaphragm chamber of said EGR valve with the EGR port arranged near the throttle valve of the carburetor;
- a relief pipe diverging from said communicating pipe between said orifice and said EGR valve, and;
- a vacuum control valve (VCV) mounted at the opening end of said relief pipe.

In this known EGR system, said vacuum control valve (VCV) comprises a diaphragm and two chambers defined by the diaphragm and the valve body, one of the chambers communicating with the atmosphere and the other communicating with said pressure control chamber of the EGR valve.

In the above EGR system, the amount of the EGR is controlled by the EGR valve actuated by said VCV which operates so that the pressure in said pressure control chamber keeps constant. Such operation maintains the EGR ratio (the ratio of the amount of the recirculated exhaust gas to that of all the exhaust gas) constant no matter what the engine condition is. Accordingly, in the low-loaded condition of the engine the exhaust gas is recirculated using the same ratio as in the high-loaded condition of the engine in which a large amount of the exhaust gas is recirculated in order to clean the discharged exhaust gas. Consequently, in the low-loaded condition of the engine, an excessive amount of exhaust gas is recirculated with the result of degrading driveability of the vehicle and lowering the output force of the engine.

SUMMARY OF THE INVENTION

An object of the present invention is to provide an EGR system in which the above drawbacks are obviated.

According to the invention, the construction of the VCV is improved as follows.

The VCV according to the invention comprises:

- a first diaphragm;
- a second diaphragm;
- a first chamber which is formed outside said first diaphragm and communicating with the atmosphere;
- a second chamber which is formed between said first and second diaphragms and communicating with the pressure control chamber of the EGR valve, and;
- a third chamber which is formed outside said second diaphragm and communicating with the intake pipe of the engine at the downstream of the throttle valve of the carburetor.

DETAILED DESCRIPTION OF THE INVENTION

The present invention will now be further described with reference to the accompanying drawings, in which.

Figure 1:
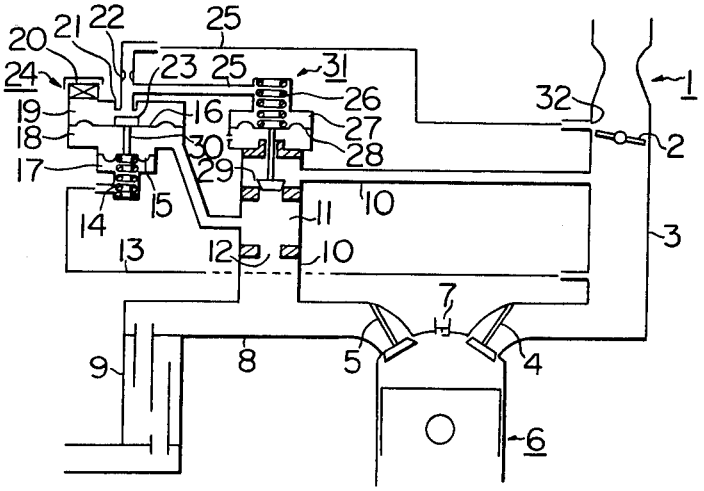
FIG. 1 is a diagrammatic view of the EGR system according to the invention.

Referring to FIG. 1, 1 is a carburetor; 2 is a throttle valve; 6 is an engine body; 4 is an intake valve; 5 is an exhaust valve; 7 is an igniter and 9 is a muffler. A diaphragm type EGR valve 31 is arranged on the EGR pipe 10 which connects the exhaust pipe 8 and the intake pipe 3. A pressure control chamber 11 is arranged at the inlet of said EGR valve 31. The inlet of said chamber 11 is formed by an orifice 12. A diaphragm chamber 27 of said EGR valve 31 communicates with an EGR port 32 which is arranged near the throttle valve 2 of the carburetor 1 through a communicating pipe 25. Number 26 is a spring; 28 is a diaphragm and 29 is a valve. In FIG. 1, the valve 29 is closed. An orifice 22 is arranged on said communicating pipe 25. A relief pipe 21 diverges from said communicating pipe 25 between said orifice 22 and said EGR valve 31. A vacuum control valve (VCV) 24 is arranged at the opening end of said relief pipe. The VCV 24 comprises: a first diaphragm 16; a second diaphragm 15; a first chamber 19 which is formed outside said first diaphragm 16 and communicating with the atmosphere through a filter 20; a second chamber 18 which is formed between said first and second diaphragms 16, 15 and communicating with said pressure control chamber 11 of said EGR valve 31, and; a third chamber 17 which is formed outside said second diaphragm 15 and communicating with the intake pipe 3 of the engine at the downstream of the throttle valve 2. The distance between the first and second diaphragms 16, 15 is kept constant by a rod 30. The effective diameter of the first diaphragm 16 is greater than that of the second diaphragm 15. Number 23 is a valve and 14 is a spring.

The operation of the EGR system according to the invention will now be described.

When the throttle valve 2 is closed, the pressure at the EGR port 32 is equal to atmospheric pressure. Accordingly, the atmospheric pressure acts upon the diaphragm chamber 27 of the EGR valve 31 through the communicating pipe 25, thereby depressing the diaphragm 28 and the valve 29 cooperating with said diaphragm 28. In this way, the EGR valve 31 is closed to stop the recirculation of the exhaust gas.

In the loaded condition of the engine, that is, when the throttle valve 2 opens slightly beyond the EGR port 32, the pressure at the EGR port 32 is equal to the intake vacuum pressure of the engine. Accordingly, if the VCV 24 is closed, said intake vacuum acts upon the diaphragm chamber 27 to draw up the diaphragm 28 and the valve 29. In this way, the EGR valve 31 opens to recirculate a part of the exhaust gas. In this operation, if the valve 29 opens excessively and thereby an excessive amount of the exhaust gas is recirculated, the pressure in the pressure control chamber 11 is lowered. Accordingly, the pressure in the second chamber 18 which communicates with said pressure control chamber 11 is also lowered with the result being that the valve 23 moves downward by the force created due to the difference between the diameters of the first and second diaphragms 16, 15. Consequently, the relief pipe 21 opens to the atmospheric pressure, which acts upon the diaphragm chamber 27 of the EGR valve 31 to depress the valve 29. Thereby the opening of the EGR valve 31 is decreased. At this time, the atmospheric pressure does not act upon the EGR port 32 because of the orifice 22.

In the above operation, if the opening of the EGR valve 31 is decreased excessively and thereby the amount of EGR decreases, the pressure in the pressure control chamber 11 rises. Accordingly, the pressure in the second chamber 18 which communicates with said pressure control chamber 11 also rises, causing the valve 23 to move upward and thereby causing the VCV 24 to be closed. Then, the intake vacuum acts again upon the diaphragm chamber 27 of the EGR valve 31 through the EGR port 32 and the communicating pipe 25 causing the valve 29 to rise and thus increasing the amount of EGR.

In this way, the EGR valve 31 is controlled so that the opening is automatically decreased when the EGR amount is too large. In the contrary, the opening of the EGR valve 31 is automatically increased when the amount of EGR is too small.

The third chamber 17 of the VCV 24 operates as follows.

In the low-loaded condition of the engine, that is when the opening of the throttle valve 2 is relatively small, a high intake vacuum pressure acts upon the third chamber 17 through the communicating pipe 13. Accordingly, the second diaphragm 15 is forced to move downward while the cooperating first diaphragm 16 and the valve 23 also are forced to move downward. Consequently, a relatively high pressure in the second chamber 18 is required to close the VCV 24; that is, in order to close valve 23, the upward force which acts upon the valve 23 due to the pressure in the pressure control chamber 11 has to be greater than the downward force, due to the intake vacuum. In this way, the opening of the EGR valve 31 is controlled for maintaining the pressure in the control chamber 11 at a relatively high level, which condition is achieved by decreasing the amount of EGR. Accordingly, the amount of EGR under such control remains small in the low-loaded condition of the engine.

As the throttle valve 2 opens wider, the vacuum pressure in the intake pipe 3 is lowered. At the same time, the vacuum pressure in the third chamber 17 is also lowered, thereby weakening the downward force which acts upon the valve 23. Accordingly, VCV 24 is operated by a pressure lower than that of the low-loaded condition. The EGR valve 31 is controlled for maintaining a relatively low pressure in the control chamber 11 which condition acquires a large amount of EGR.

By this method, the pressure in the pressure control chamber 11 is adjusted in response to the opening of the throttle valve instead of being kept constant. Accordingly, in the high-loaded condition of the engine, a large amount of exhaust gas is recirculated in order to clean the emission. On the other hand, in the low-loaded condition of the engine, the EGR ratio is decreased in order to avoid degrading driveability of the vehicle and lowering the output force of the engine.

Figure 2:
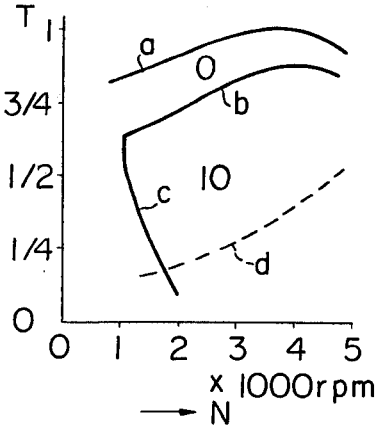
FIG. 2 shows the EGR ratio of the known EGR system.
Figure 3:
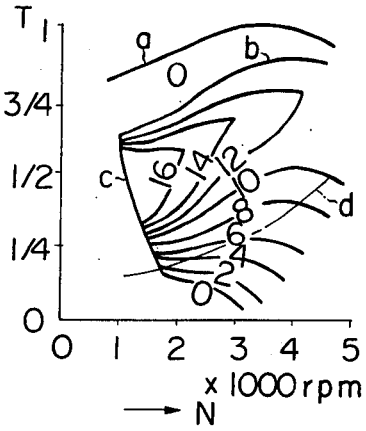
FIG. 3 shows the EGR ratio of the EGR system according to the invention.

FIG. 2 and FIG. 3 show the EGR ratio defined by the number of revolutions N and the engine load T during the various conditions of the engine. FIG. 2 illustrates a case of using the known EGR system. FIG. 3 illustrates a case of using the EGR system according to the invention. Numerals marked in FIG. 3 are values of the EGR ratio calculated by a computer. In each of the Figures, line *a* shows wide opening throttle line; line *b* shows the boundary line of the EGR operation near wide opening throttle condition determined by the property of the diaphragm and the spring of the EGR valve; line *c* shows the boundary line of the EGR operation near the closed condition of the throttle valve determined by the location of the EGR port; and line *d* shows the normal condition of the engine of a vehicle at constant speed on flat ground. As shown in FIG. 2 by the inside lines *b* and *c*, indicating how EGR is operating, the EGR ratio is kept constant (in this particular case 10% all throughout the area); that is 10% of the exhaust gas is always recirculated no matter what the engine condition is in. On the other hand, as shown in FIG. 3, the EGR ratio is decreased substantially as the engine load is decreased.

What is claimed is:

1. An exhaust gas recirculation system comprising:
   - a diaphragm type EGR valve mounted on an EGR pipe which connects the exhaust pipe with the intake pipe of the engine;
   - a pressure control chamber formed at the inlet of said EGR valve;
   - an orifice mounted on a communicating pipe which connects the diaphragm chamber of said EGR valve with the EGR port arranged near the throttle valve of the carburetor;
   - a relief pipe diverging from said communicating pipe between said orifice and said EGR valve, and;
   - a vacuum control valve mounted at the opening end of said relief pipe, wherein said vacuum control valve comprises:
   - a first diaphragm;
   - a second diaphragm;
   - a first chamber which is formed outside said first diaphragm and communicating with the atmosphere;
   - a second chamber which is formed between said first and second diaphragms and communicating with said pressure control chamber, and;
   - a third chamber which is formed outside said second diaphragm and communicating with said intake pipe of said engine at the downstream of said throttle valve of said carburetor.

2. An exhaust gas recirculating system according to claim 1, wherein the effective diameter of said first diaphragm is greater than that of said second diaphragm.

3. An exhaust gas recirculating system according to claim 2, wherein the distance between said first and second diaphragms is kept constant by a rod arranged between them.

* * * * *